United States Patent [19]

LaCroix, Jr.

[11] 4,187,663

[45] Feb. 12, 1980

[54] SADDLE GIRTH

[76] Inventor: Gene LaCroix, Jr., 17011 N. 54th St., Scottsdale, Ariz. 85255

[21] Appl. No.: 832,655

[22] Filed: Sep. 12, 1977

[51] Int. Cl.[2] ..... B68C 1/00

[52] U.S. Cl. ..... 54/23

[58] Field of Search ..... 54/23, 46, 58

[56] References Cited

U.S. PATENT DOCUMENTS

| | | | |
|---|---|---|---|
| 1,678,373 | 7/1928 | Wiesenfeld | 54/23 |
| 2,239,764 | 4/1941 | Vordemberge | 54/23 |
| 2,567,019 | 9/1951 | Johnson | 139/423 |
| 3,457,702 | 7/1969 | Brown | 54/46 |
| 3,828,521 | 8/1974 | Dulaney | 54/23 |
| 3,918,407 | 11/1975 | Greenberg | 119/106 X |
| 4,018,035 | 4/1977 | Morrison | 54/23 |

OTHER PUBLICATIONS

Edwards, Hartley, E., *Saddlery,* A. S. Barnes and Co., 1963, pp. 137–141.

*Primary Examiner*—Russell R. Kinsey
*Assistant Examiner*—Robert P. Swiatek
*Attorney, Agent, or Firm*—Wells, St. John & Roberts

[57] ABSTRACT

A saddle girth is described that includes a central belt portion that is constructed entirely of an elastomeric substance, particularly a plasticized polyvinyl chloride. The girth includes a fastening means at opposite ends for attachment to the saddle billets of a typical riding saddle. The portion of the girth that comes into contact with the horse is a smooth expansible surface of the belt portion. This girth will expand and contract in response to breathing and movements of the horse and will not chafe the adjacent skin tissues nor become soaked with sweat and grime.

10 Claims, 4 Drawing Figures

SADDLE GIRTH

BACKGROUND OF THE INVENTION

The present invention relates to saddlery and more particularly tp expandable girths for riding saddles. The saddle girth is a very important part of a horseman's "tack" and care is warranted in its selection. The saddle girth or cinch is often the only substantial part of the saddle gear that actally holds the saddle on a horse's back. Certainly it is the girth that must withstand much of the ordinary stresses supplied by the weight of a rider and the movements of the horse.

The girth is connected at opposite ends to saddle billets on the riding saddle between the saddle flaps and sweat flaps. The girth extends from one of these connections on one side of the horse, under the chest, and to the opposite side of the horse where its remaining end is connected to the remaining saddle billet.

In saddling a horse, the rider or stableman will try to obtain a snug fit between the girth and the horse's rib cage. This is often difficult if the girth is cinched at the time the horse has taken a deep breath or has otherwise distended the "barrel" or chest cavity of the horse. Unless the girth happens to be of an elastic nature, it will quickly loosen when the rib cage is contracted. There is danger of slippage from a loose girth both to the horse and its rider. Of course, the danger to the rider is that the saddle will slip to the side of the horse and the rider will consequently fall. When the girth is only slightly loose, the danger to the horse is that the loose girth will continuously rub across its tender skin and cause chafing and possible further damage in the form of ulcerations, etc. if such misuse continues.

It may certainly be seen that it is desirable to obtain some form of saddle girth that is accommodating to such stresses. Several such girths are in current use. However, they are constructed of a woven "elastic" material that will become easily saturated with grime, dust and sweat. Once this happens, the girth hardens and does not retain its proper elastomeric properties. Further, the hardened material will rub and chafe against the horse's skin causing the above-mentioned maladies.

U.S. Pat. No. 2,567,019 granted to W. C. Johnson on Sept. 4, 1951 discloses an expansible band for use in saddles. This band is typical of the present forms now being utilized. Bands such as that disclosed by Johnson do have initial utility but their useful life is very limited unless extreme care is taken in keeping the girth material clean.

Another form of girth is illustrated in U.S. Pat. No. 1,678,373 to J. Wiesenfeld granted July 24, 1928. This shows a slightly different variation of the typical leather girth wherein an enclosed elastic band is provided adjacent the opposite ends of the girth belt. Here, the elastic is covered with leather to protect it from the effects of both weather and sweat from the horse. It should be noted that the remainder of the girth body is leather and, as such, needs constant care.

Another form of girth is illustrated in U.S. Pat. No. 3,828,521 to Dulaney issued Aug. 13, 1974. Dulaney discloses an elastic cinch that is similar in function and design to the girth disclosed by Wiesenfeld. Dulancy, however, also discloses a padded girth body that is intended to reduce chafing. The elastic bands extending between the girth buckles and girth body are exposed to the underside of the horse and the pad is covered with a soft leather material.

Other forms of girth materials and girth construction are discussed and illustrated in a book titled "Saddlery" by E. Hartley Edwards, Copyright 1963, and published by A. S. Barnes and Co., Inc. Edwards discusses several materials utilized in the construction of saddle girths, including: fabric web; all elastic; lampwick; tubular web; and nylon cord. These forms are in addition to the typical solid leather form of girth that is now commonly used.

The difficulty with all the web, elastic and lampwick forms is corrosion. Sweat will quickly rot the fabric of these types of girths and, if not washed regularly, will harden and often cause chafing.

Often, a tube formed of polyethylene may be slipped over the belt portion of a girth to protect both the girth from becoming saturated with sweat and to prevent chafing against the horse's underside. Usually, the material is supplied in rolls and must be cut into the proper lengths and positioned over the girth prior to the saddling operation. These tubes wear easily and must ordinarily be discarded after a single use.

The difficulty with the nylon cord form of girth is that the several cords must be gathered and held at the ends to enable connection to buckles. This is a rather clumsy connection and requires the use of an awkward form of connecting buckle. Further, the multiple nylon strands do not easily lend themselves to proper cleaning.

It is a primary object of the present invention to provide an extremely reliable form of saddle girth that is not affected by either weather conditions or by the deleterious effect of sweat.

Another important object is to provide such a girth that is elastomeric and yet constructed of a single piece of belt material that will present a smooth surface to ride against the horse's skin.

An additional object is to provide such a girth wherein the belt is constructed of a highly abrasion resistant material that also presents desirable elastic properties.

These and still further objects and advantages will become apparent upon reading the following description which, taken with the accompanying drawing, disclose a preferred form of my invention. It is to be understood however that the description and drawing are set forth as mere examples of the preferred form of construction of my invention and that various other forms may be devised therefrom. Therefore, only the claims found at the end of this specification are to be taken as definitions of my invention.

DETAILED DESCRIPTION OF A PREFERRED EMBODIMENT

Figure 1:
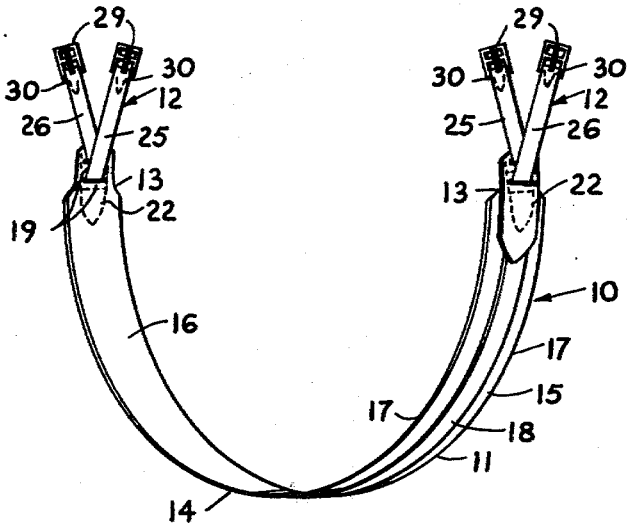
FIG. 1 is a pictorial view of the present girth structure.

A preferred form of the present invention is designated in the accompanying drawing by the reference character 10. The girth 10 is constructed of a solid plastic elastomeric belt 11 having a fastening means 12 at each of its ends 13. The fastening means 12 is adapted to connect to appropriate saddle billets (not shown) of the conventional riding saddle. In operation, the girth will extend from a saddle billet on one side of a horse under the chest cavity and up to the opposite side of the chest cavity to connect to the remaining saddle billet on that side. The belt 11 will continuously and firmly hold the saddle in place against the skin of the horse when the girth is properly mounted to a saddle.

The belt body is indicated at 14 and is formed of a solid mass of the plastic material. The belt includes an outside surface 15 and a smooth inside surface 16. It is the smooth inside surface 16 that will ride against the chest cavity of the horse. Therefore, it is important that this surface be smooth so as not to abrade the horse's sensitive skin and thereby cause what is commonly known as "girth galls". Surfaces 15 and 16 are joined by curved edges 17. Again, the edges are curved to prevent gouging and abrasion against the sensitive flesh.

It is important to note that the belt is formed of a uniform solid mass of material rather than a woven conglomeration of strands. This feature is important for two reason. First, the solid belt presents the smooth continuous inside surface 16 for enaging the horse's flesh that will not chafe, and secondly, the smooth continuous surfaces 15, 16 are easily cleaned since they are not penetrated by moisture or dirt.

Figure 2:
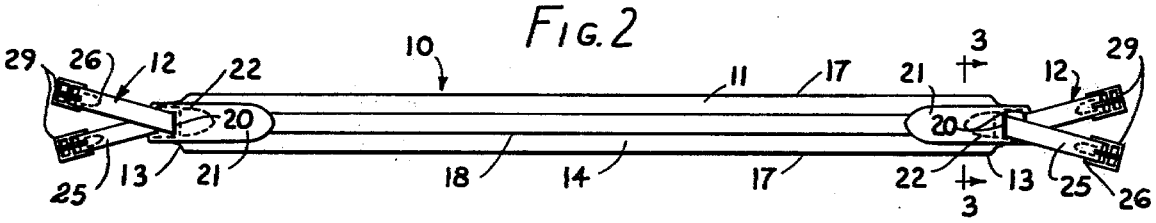
FIG. 2 is a plan view of the girth.

The outside surface 15 may be planar in configuration or may be provided with some form of decoration for show purposes. Specifically, the form illustrated in FIGS. 1 through 3 includes a decorator strip 18 that may be provided and colored differently than the remainder of belt 11. The strip 18 may be formed integrally with belt 11 or may be attached by adhesive.

The opposite ends 13 of belt 11 include longitudinally spaced slots 19. These slots extend completely through the thickness of belt 11 to receive the fastening means 12. Slots 19 are in alignment with complementary slots 20 provided in leather gussets 21. The gussets 21 are fastened to the opposite ends 13 of belt 11 to provide reinforcement for the belt adjacent the slots 19. The gussets are shown as being attached by stitching at 22. However, the gussets may be attached securely by other means. The gusset slots 20 are vertically aligned with the slots 19 to receive the fastening means 12.

Figure 3:
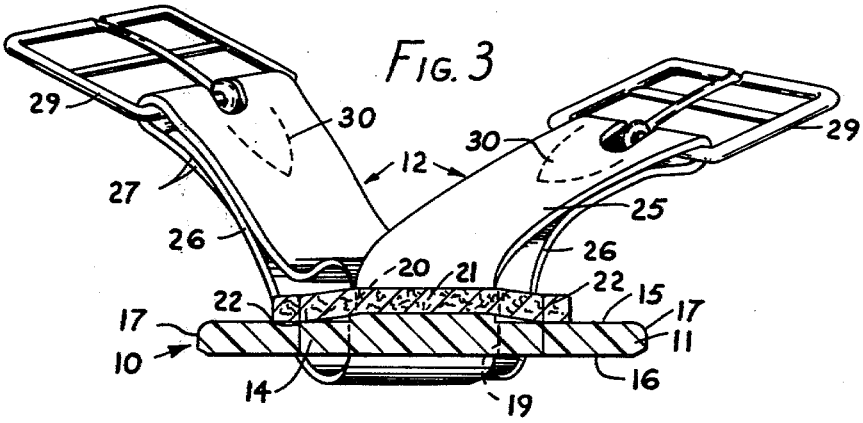
FIG. 3 is an enlarged sectional view taken along line 3—3 in FIG. 2.
Figure 4:
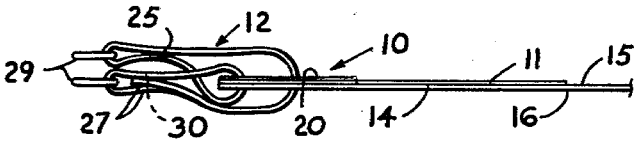
FIG. 4 is a fragmentary view showing one end of the girth in an elevational plane.

The fastening means 12 is illustrated in some detail in FIG. 3. Basically, fastening means 12 is made of straps 25 at the opposite ends 13 of belt 11. The straps 25 have buckle members 29 for attaching to the saddle billets. Each strap 25 is comprised of a single leather thong 26. Each thong 26 is threaded through the spaced slots 20 and 19 to form two closed loops spaced outwardly of the belt ends 13. The thongs include ends 27 that are fastened by stitching 30. The buckles are of conventional form utilized in saddlery and need not be discussed in greater detail.

Of great importance is the particular construction of the belt 11. As discussed, the belt 11 is formed as an integral solid unit of a plastic material. In a preferred workable form, the belt is formed of a fused dispersion of fine particle-sized polyvinyl chloride in a phthalate ester plasticizer of a uniform longitudinal and transverse density. This material is commonly known as plastisol and is often supplied in a liquid state. The material will fuse into a solid elastomeric mass upon heating at a specified temperature (for example, 350° to 375° F.) over a specified time (for example, 12 min.). It is preferable that the material resulting from the combination of plasticizer and polyvinyl chloride have the following approximate physical properties: tensile strength—2,456 psi; tear strength—277 psi; ultimate elongation—300 to 450% but preferably 387%; and Shore A hardness—75. I have found that a plastisol product "MX913" produced by "Plast-O-Meric" Inc. of Waukesha, Wisconsin presents properties similar to these and may be used for the purposes of this invention.

The material is extremely flexible in nature and sufficiently elastic to conform and hold snug against the rib cage of a horse without chafing. The physical nature of the plastisol material is such that it is abrasion resistant and does not absorb moisture nor is it affected by weather as are the prior forms of saddle girths. Thus, the present girth may be used in the same manner as prior forms but may be cleaned simply by wiping with a damp cloth. Even this is not necessary in so far as corrosion is not affected by the horse's sweat. The material has exceptionally long life and will not chafe against the tender skin. Further, the many colors and decorative effects that may be produced with the plastisol material are nearly unlimited in application.

During use, when the girth is in place on a horse, the belt will expand and contract (due to its elongation properties) in response to movements of the horse without restricting normal breathing or to reacting against unusual motion by rubbing across the tender skin that it contacts. The continuous smooth inside surface 16 will flex with the horse's adjacent flesh and will therefore cling in a fixed area without any noticeable rubbing. When the girth becomes dusty and damp, it may be cleaned with ordinary cleaning compounds (a damp cloth will do). Since the belt material is not porous it will not become soaked with sweat and therefore no special care or compounds must be used for cleaning and preserving.

The above description and drawing have set out a preferred example of the present girth but it is understood that other forms not disclosed will fall within the scope of my invention. Therefore, only the following claims are to be taken as restrictions upon the scope of my invention.

What I claim is:

1. A saddle girth comprising:

an elongated belt portion formed of a fused solid elastomeric plastisol plastic material having a smooth inside non-moisture absorbent, abrasive resistent surface for engagement with the flesh of a horse about its rib cage and an outside surface, the plastic material being non-porous so as to not absorb moisture within the elongated belt portion during use;

wherein the belt portion is formed of a platisol plastic material comprising plasticized polyvinyl chloride having an ultimate elongation of between 300% and 450%; and strap fastening elements at opposite ends of the belt portion adapted to be secured to a riding saddle.

2. The saddle girth as set out by claim 1 wherein the belt portion is formed of a plastisol plastic material comprising plasticized polyvinyl chloride material.

3. The saddle girth as set out by claim 1 wherein the strap fastening elements are comprised of flexible straps having buckle members at outward ends thereof and wherein the straps are secured to the opposite ends of the belt portion.

4. The saddle girth as set out by claim 1 wherein the belt portion is formed of a plastisol plastic material comprising plasticized polyvinyl chloride having an ultimate elongation of between 300% and 450%.

5. The saddle girth as set out by claim 1 wherein the belt portion is formed of a plastisol material having fine particle size polyvinyl chloride dispersed in a phthalate ester and includes a Shore A hardness of approximately 75.

6. The saddle girth as set out by claim 1 wherein the belt portion is formed of a plastisol material comprising a fused dispersion of fine particles size polyvinyl chloride in a phthalate ester plasticizer and includes the following physical properties: (a) tear strength—227 psi; (b) ultimate elongation—387%; (c) Shore A hardness—75; and (d) tensile strength—2456 psi.

7. The saddle girth as set out by claim 1 wherein the opposite ends of the belt portion are reinforced with gussets that are adapted to receive the fastening means.

8. The saddle girth as set out by claim 1 wherein the strap fastening elements are comprised of flexible straps, each having two buckle members at outward ends thereof for attachment to complementary mating members of the saddle and wherein the straps are made up of a single thong provided at each of the opposite belt ends, the thong being folded onto itself and connected to the belt portion to form the outward strap ends.

9. The saddle girth as set out by claim 8 further comprising reinforcing gussets at the opposite ends of the belt portion that are slotted to receive the thongs, and wherein the belt portion includes slots, matching the slots of the gussets also for receiving the thongs.

10. The saddle girth as set out by claim 9 wherein the thongs and gussets are leather and wherein the gussets are stitched to the opposite belt ends.

* * * * *